United States Patent [19]

Brougham

[11] 4,123,736

[45] Oct. 31, 1978

[54] LEAKAGE REACTANCE TRANSFORMER

[75] Inventor: William K. Brougham, Novar Gardens, Australia

[73] Assignee: Welding Industries of Australia Pty. Ltd., Thomastown, Australia

[21] Appl. No.: 725,733

[22] Filed: Sep. 23, 1976

[30] Foreign Application Priority Data

Sep. 23, 1975 [AU] Australia ..... 3289/75

[51] Int. Cl.[2] ..... H01F 21/04; H01F 21/06

[52] U.S. Cl. ..... 336/120; 29/606; 336/133

[58] Field of Search ..... 29/606; 336/130, 131, 336/132, 133, 134, 135, 119, 120, 234, 117, 118

[56] References Cited

U.S. PATENT DOCUMENTS

| | | | |
|---|---|---|---|
| 1,500,082 | 7/1924 | Langdon-Davies et al. | 336/120 X |
| 1,771,551 | 7/1930 | Strohschneider | 336/120 X |
| 2,270,178 | 1/1942 | Weis et al. | 336/120 |
| 2,475,044 | 7/1949 | Mulder | 336/120 |
| 2,811,203 | 10/1957 | Garbarino | 336/234 X |
| 3,205,561 | 9/1965 | Brutt et al. | 336/234 X |

FOREIGN PATENT DOCUMENTS

| | | | |
|---|---|---|---|
| 1,463,203 | 12/1966 | France | 336/120 |

*Primary Examiner*—Thomas J. Kozma
*Attorney, Agent, or Firm*—Murray & Whisenhunt

[57] ABSTRACT

This specification discloses a leakage reactance transformer for supplying electric arc welding current and comprising a core formed from a stack of laminations having a central 'key-hole' shaped opening punched therein and defining an arcuate core portion and two spaced legs. The core has primary and secondary windings mounted thereon and a keeper secured to the legs to close the flux path of the core. One of the windings is mounted on a frame which is pivoted relative to the core so that the winding is movable along the arcuate core section towards and away from the other winding. A magnetic shunt member is also mounted on the frame approximately 180° from the movable winding and in one position bridges the gap between the legs of the core and in another position is remote from this gap. In the bridging position the shunt contributes to the leakage reactance of the transformer and in the remote position contributes substantially no leakage reactance. The shunt is formed from a sector of the portion of the laminations cut from the core to define the arcuate section of the opening and the keeper is formed from the remainder of the portion cut from the core and defining the space between the legs of the core. The core and windings are mounted within a casing and means are provided to facilitate the pivotal movement of the movable winding and shunt to any position between the two extremes whereby the welding current may be infinitely varied between the values at the extremes.

In a modification two similar cores are connected together by their legs and a movable winding and shunt member is mounted on each. In this arrangement the output current range is increased.

7 Claims, 7 Drawing Figures

LEAKAGE REACTANCE TRANSFORMER

This invention relates to leakage reactance transformers, particularly those suitable for use in supplying electric arc welding currents or in other situations where current control is required.

At the present time, there are basically two distinct types of leakage reactance welding transformers. These are commonly referred to as the moving coil type and the moving shunt type.

The moving coil transformer has a fixed secondary winding and a primary winding coil mounted for movement along the centre legs of the transformer core towards and away from the fixed secondary. By positioning the movable coil at maximum spacing from the secondary, the leakage reactance of the transformer is at a maximum and the volt/amp (V/A) output is at a minimum. When the coils are brought close together, the leakage reactance is minimised and the V/A output is at a maximum.

The rate of increase of leakage reactance with respect to distance between the windings is not linear but logarithmic and so in order to achieve a reasonable variation in the V/A output between the minimum and maximum values, the transformer core must be made with a long leg length. This results in high transformer costs.

The moving shunt transformer includes a steel shunt movably mounted on a frame located between the primary and secondary windings and capable of movement into and out of the space between the windings. The positioning of the shunt between the windings increases the leakage reactance and provides minimum V/A output determined by the size of the shunt and the sum of the air gaps between the shunt and the core. Maximum V/A output is achieved by fully withdrawing the shunt but because the windings must be spaced for the shunt the maximum that can be achieved is limited.

When design requirements dictate a low V/A requirement or a large min/max ratio then the size of the shunt must be increased and the air gaps decreased thus increasing the magnetic forces on the shunt. This increases the need for precision slides to accurately guide the shunt frame between the windings. As the slides wear, jamming and other problems occur and complex arrangements are required to overcome this problem.

A number of different transformer constructions in which the moving coil and shunt functions are combined, are described in the patent literature: for example, British Pat. Nos. 227,360 Schrodder, 642,326 National Cylinder Gas Company, 764,699 Metropolitan-Vickers Electrical Company Limited and 1,162,972 The English Electric Company Limited, U.S. Pat. No. 2,572,455 Dunn and French Pat. Nos. 1,014,815 and 1,463,203 Testuz. However, each suffers from the disadvantage that it is not sufficiently simple to manufacture to be a commercially attractive alternative to the transformers described above.

In one aspect therefore, the invention provides an improved transformer comprising a magnetic core formed from a stack of laminations and having a closed flux path, primary and secondary windings of said core, one of said windings being movable relative to the other to vary the current output of the transformer, and a magnetic shunt means adapted for movement from a first position in which it contributes to the leakage reactance of the transformer to a second position in which it contributes substantially no leakage reactance, at least that portion of said core between the primary and secondary windings being arcuate and said movable winding being mounted for arcuate movement along said portion, said shunt means being movable with said movable winding such that when said movable winding is most remote from the other winding said shunt means is in its first position and when said movable winding is close to the other winding said shunt means is in its second position, characterized in that said core is formed with an opening defining said arcuate portion and two spaced legs, a keeper secured to the free ends of said legs to close the flux path, said magnetic shunt means being formed from that portion of the laminations removed to form the arcuate portion of said opening and substantially bridging the gap between said legs in said first position.

In its most preferred form the magnetic core is formed with a substantially circular aperture substantially concentric with said arcuate portion, and rectangular opening communicating with said aperture to create said legs on either side thereof, said shunt being located within said aperture and bridging the opening therein in said first position. Thus, the core may be regarded as having a 'key-hole' shaped window therein.

In order that the invention may be more readily understood, two embodiments of the invention will now be described with reference to the accompanying drawings in which.

Figure 2:
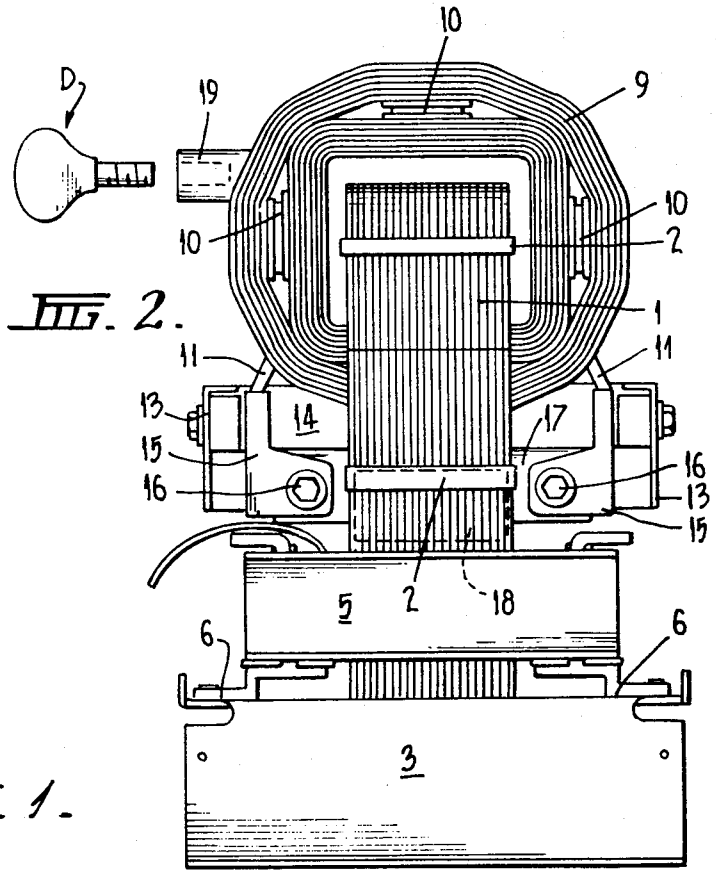
FIG. 2 is a side elevation of the assembly of FIG. 1.
Figure 1:
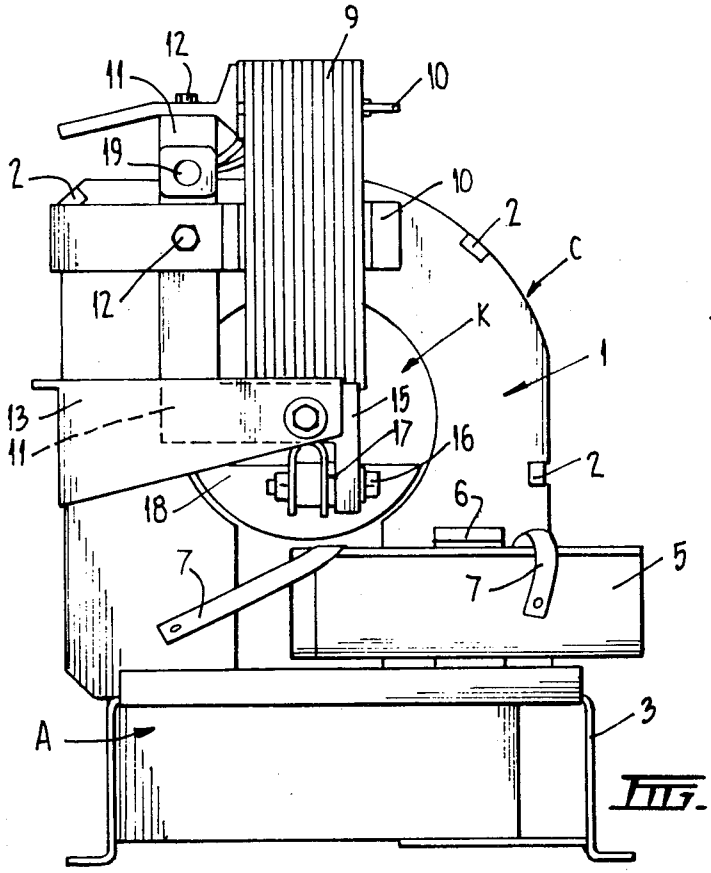
FIG. 1 is a front elevation of a transformer assembly embodying the invention.
Figure 3:
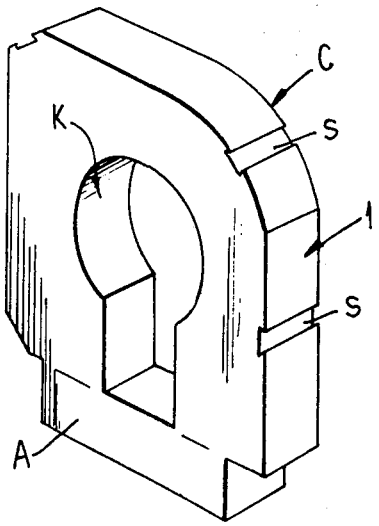
FIG. 3 is a perspective view of the transformer core.

Referring firstly to FIGS. 1 to 3, the transformer includes a steel core 1 formed from a stack of steel sheet laminations which are cut in the configuration shown in FIG. 3 by punching or any other suitable means. The stack of steel sheets is held together by clips 2 secured in slots S formed in the edges of the sheets. It will be noted that the basic core element is of square configuration with one corner C of the square rounded and having a centrally position 'key-hole' K cut therethrough. The magnetic circuit of the core 1 is completed by a laminated steel keeper A of rectangular configuration which is welded to the side of the core element through which the 'key-hole' K opens. The keeper A is cut from the 'key-hole' cut out from the core 1 and comprises that portion between the legs of the core 1 extended to a position adjacent the periphery of the circular portion of the 'key-hole' configuration. The core 1 is suitably mounted on a base 3 on which the casing 4 (FIG. 4) for the transformer is secured.

Figure 4:
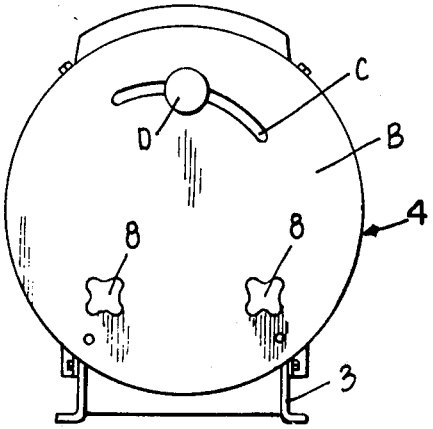
FIG. 4 is a front view of the transformer housing.

Prior to the securement of keeper A to the core 1, a secondary winding coil 5 is positioned around one leg of the core 1. The coil 5 is formed around brackets 6 by means of which the coil 5 is secured to the base 3. The coil 5 is formed from an aluminium strip insulated by Nomex paper or any other suitable combination. Leads 7 are provided for connection to output terminals 8 (FIG. 4).

Also prior to securement of the keeper A to the core 1, a primary winding coil 9 wound from glass covered aluminium wire or other suitable material on three suitably insulated support brackets 10 is positioned on the core and secured to a supporting frame 11 of the configuration shown by bolts 12 passing through the brackets 10 as shown. The frame 11 is in turn pivotally mounted on brackets 13 extending on either side of the core 1 and rigidly secured thereto by a cross bar 14. The bearings supporting frame 11 are preferably tapered to reduce transmission of vibrations. The frame 11 has extension lugs 15 extending downwardly and inwardly towards the core 1 and through which bolts 16 pass for securing a clamping bracket 17 adapted to hold a laminated steel shunt 18. The shunt 18 comprises one of the sectors remaining in the 'key-hole' cut out after the keeper A has been cut therefrom so its lower end matches exactly the curvature of the central opening of the 'key-hole' K. Thus, the use of this sector as the shunt 18 not only ensures matching curvature of the shunt 18 and the 'key-hole' K whereby pivotal movement is facilitated but also utilizes the material cut-out from the core 1 whereby the economics of manufacture are improved. The dimensions of the shunt 18 are such as to bridge the gap between the legs of the core 1 and form a flux path between the legs. The shunt 18 is of course electrically insulated from the frame 11 bolts 16 and bracket 17 by suitable insulating washers and bushes.

It will be evident from the above that the primary winding coil 9 and the steel shunt 18 are supported by a common frame 11 with the shunt 18 at about 180° to the coil 9, the common frame 11 being pivotally mounted on brackets 13. Thus, when the coil 9 is moved arcuately from the position shown in FIG. 1 to a position adjacent the secondary coil, the shunt 18 will be moved through the same angle to a position wherein it is remote from the gap between the legs of the core 1.

In this way, the transformer embodying the invention effectively combines the moving coil and moving shunt features of the prior art devices. In the position shown in FIG. 1, the coil 9 is remote from the coil 5 while the shunt is in the most effective position to maximise the additional leakage reactance introduced by the shunt and minimum V/A output is achieved. Maximum V/A output is achieved when the coil 9 is fully pivoted to a position adjacent secondary winding coil 5 and since the shunt is completely removed from the gap it contributes effectively no leakage reactance to the magnetic circuit.

Since the transformer embodying the invention incorporates substantial leakage reactance due to the spacing of the coils in the position shown in the drawing, the size of the shunt 18 is relatively much smaller and the air gaps greater than in the prior art moving shunt design. Thus the usually mandatory requirements of the moving shunt design are avoided and a greatly simplified design is permitted.

Figure 7:
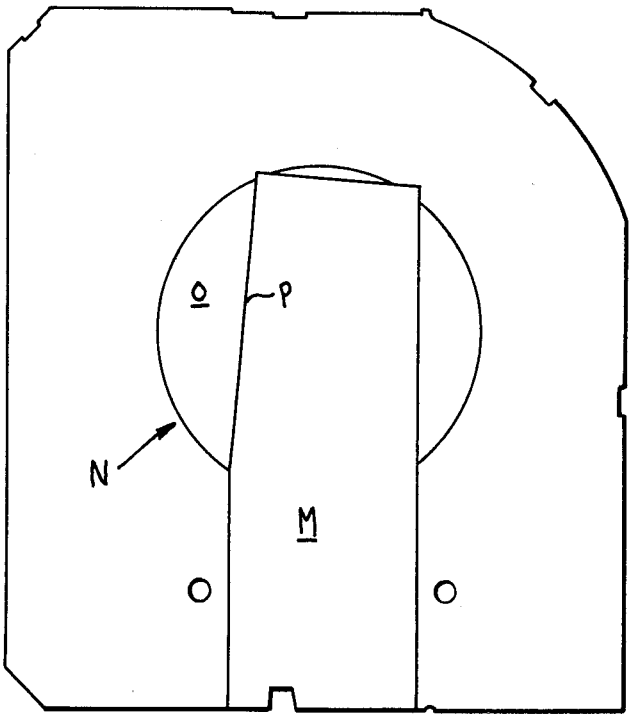
FIG. 7 is a plan view of one preferred form of lamination configuration.

One particularly preferred lamination shape is shown in FIG. 7. The lamination has a central cut-out M for the keeper A and a circular cut-out N which in turn defines the sector O to be used as the shunt 18. It will be seen that the cut-out M has one portion P of one side extending at an angle to the remainder of the side. This increases the size of sector O to therefore increase the volume of metal included in the shunt 18 so that the low-current output is improved. The remaining smaller sectors are wasted.

It will be apparent from the drawing that the amount of steel used in the embodiment described is substantially less than for the moving coil device and approximately the same as for the moving shunt design. Thus, in view of the simple nature of the design, a greater min/max V/A output ratio can be achieved for a lower cost. By using the section cut from the core 1 to form both the keeper A and the shunt 18, a particularly efficient commercial transformer can be manufactured which avoids all of the disadvantages inherent in the prior art combined moving coil/shunt arrangements referred to above. The described arrangements solve the problems associated with the manufacture of a pivoted moving coil/shunt transformer and which are largely ignored by the prior art such as French Pat. No. 1,463,203.

It will be appreciated that the roles played by the windings 5 and 9 may be reversed, i.e., winding 5 may operate as the primary while winding 9 is the secondary.

As shown in FIG. 4, the transformer described above is enclosed in a suitable casing 4 having a front panel B formed with an arcuate slot C through which a threaded operating knob D passes for engagement with a boss 19 (FIGS. 1 and 2) on the supporting frame 11. Thus, arcuate movement of the knob D moves the primary winding coil 9 and the shunt 18 as described to adjust the V/A output of the transformer. The knob D may be fixed in any desired position by screwing the knob into engagement with the front panel B. A nylon or like washer (not shown) is positioned between the panel B and the knob D for smooth operation.

Alternatively, the knob D may be internally threaded to engage a bolt passing through an arcuate slot (not shown) in the rear panel of the casing 4, through holes in the frame 11 and projecting through the slot C in the front panel B. This arrangement has the advantage that the front and rear panels may be identical.

In a further alternative, the manual arrangements described above may be replaced by a winder operating a lead screw adapted to move the frame 11 between its extreme operating positions.

Figure 5:
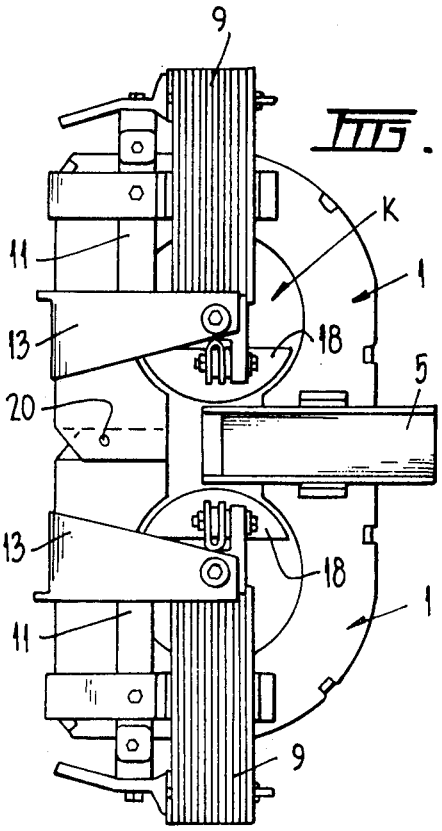
FIG. 5 is a front view of modifications including a double core transformer according to the invention.
Figure 6:
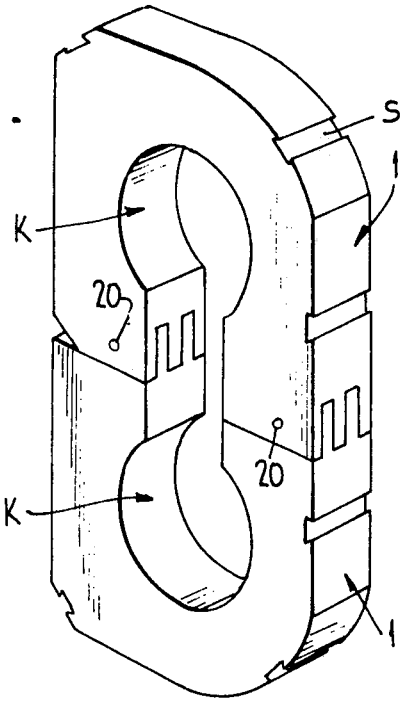
FIG. 6 is a perspective view of the core used in the embodiment of FIG. 5.

In the alternative form shown in FIGS. 5 and 6, the magnetic core of the transformer is extended by joining two cores similar to 1 described above interleaved together as shown in FIG. 6 and held together by nylon rivets 20. Alternatively, the ends of laminations in each core may be welded together in some suitable manner either with or without interleaving as shown. A single winding 5 is positioned around one leg of the composite core and two windings 9 and steel shunts 18 are arranged as in the first embodiment of the respective core components 1. The arrangement works in the same manner as before only the two windings 9 are connected in parallel to constitute the secondary winding of the transformer and both are moved towards winding 5, which is the primary in this case, when additional V/A output is required. If desired, the two support frames for cores 9 and shunts 18 may be interconnected by a suitable linkage (not shown) so that they move in union. However, separate movement provides for a greater V/A range and allows individual outputs to be derived from each secondary so as to provide a dual operator welder.

By using basically the same core stamping for both embodiments a wide range of V/A outputs can be accommodated at a lower cost.

It will be appreciated that the specific core configuration and other details described above are not essential to the invention. For example, while the 'key-hole' configuration is preferred for the core window opening, it may be possible to leave the sector of the 'key-hole' opposite to the sector removed for the shunt 18 intact so that the opening in the core 1 is P-shaped. However, with this type of arrangement the coil 9 would need to be enlarged to receive the shunt 18 and a linkage mechanism interconnecting the coil 9 and shunt 18 would be required to move the shunt 18 in the opposite direction to the coil 9. For these reasons this modification may not be a commercially attractive proposition although still technically feasible.

I claim:

1. In a transformer suitable for supplying electrical arc welding current comprising a magnetic core formed of a stack of laminated core material and having a closed flux path, primary and secondary windings having axial ends on said core, one of said windings being stationary and the other being movable relative to the stationary winding to vary the current output of the transformer, and a magnetic shunt means adapted for movement from a first position in which it contributes to the leakage reactance of the transformer, to a second position in which it contributes substantially no leakage reactance, at least that portion of said core between the primary and secondary windings being arcuate and said movable winding being arcuately movable along said portion, said shunt means being movable with said movable winding, such that when said movable winding is most remote from the other winding, said shunt means is in its first position, and when said movable winding is in close proximity to the other winding, the shunt means is in its second position, the improvement comprising a keyhole-shaped opening in said core, said opening defining an arcuate portion and two spaced legs extending therefrom with a gap between said legs, a keeper secured to the free ends of said legs to close the flux path, the stationary winding surrounding one of said legs and being free of penetration by said keeper, the movable winding surrounding said arcuate portion, said magnetic shunt means substantially bridging said gap between said legs when in said first position, wherein most of the surface area of an axial end of the movable winding is in overlapping face-to-face relationship with most of the surface area of an axial end of the stationary winding when the windings are brought into close proximity, and said windings cannot be placed in concentric relationship.

2. The transformer of claim 1, wherein said core is formed with a substantially circular aperture substantially concentric with said arcuate portion, and a rectangular opening communicating with said aperture to create said legs on either side thereof.

3. The transformer of claim 1, wherein said shunt means is sector shaped so as to be adjacent the core during its movement from its first position to its second position.

4. The transformer of claim 1, wherein said movable winding and said shunt means are supported by a common frame pivotally mounted on brackets secured to said core, said shunt means being disposed at about 180° to the movable winding and maintaining this disposition relative to said movable winding during pivotal movement of said winding and shunt means between said first and second positions.

5. A transformer comprising a pair of connected magnetic cores, each magnetic core of the pair formed from a laminated core material, and having movable windings thereon, a stationary winding associated with the pair of magnetic cores, said windings having axial ends, one of said windings in a given core being movable relative to the other to vary the current output of the transformer, and a magnetic shunt means associated with each core of the pair adapted for movement from a first position, in which it contributes to the leakage reactance of the transformer, to a second position, in which it contributes substantially no leakage reactance, at least that portion of each core between the stationary and movable windings being arcuate and said movable winding being arcuately movable along said portion, said shunt means being movable with said movable winding such that when said movable winding is most remote from the other winding said shunt means is in its first position, and when said movable winding is close to the other winding said shunt means is in its second position, a keyhole-shaped opening in each core, said opening defining said arcuate portion and two spaced legs extending therefrom having a gap between said legs, and having ends farthest from said arcuate portion, said cores being connected at the ends of said legs to provide a closed flux path, the connected cores defining a dumbbell-shaped window therein, said magnetic shunt means substantially bridging the gap between said legs when in said first position, wherein most of the surface area of an axial end of each movable winding is in overlapping face-to-face relationship with most of the surface area of an axial end of the stationary winding when the movable winding is brought into close proximity with the stationary winding, and said windings cannot be placed in concentric relationship.

6. The transformer of claim 5, wherein the movable windings of said cores are connected in parallel to consist of the secondary winding of the transformer and the single fixed winding is the primary winding of the transformer.

7. The transformer of claim 5, wherein each core is formed with a substantially circular aperture substantially concentric with said arcuate portions, and a rectangular opening communicating with said aperture and defining said legs on either side of said opening.

* * * * *